US010040310B2

(12) United States Patent
Brooks

(10) Patent No.: US 10,040,310 B2
(45) Date of Patent: Aug. 7, 2018

(54) RETENTION DEVICE FOR COLLECTIBLES IN PLASTIC COLLECTIBLES PAGES

(71) Applicant: Sean Elliot Brooks, Colorado Springs, CO (US)

(72) Inventor: Sean Elliot Brooks, Colorado Springs, CO (US)

( * ) Notice: Subject to any disclaimer, the term of this patent is extended or adjusted under 35 U.S.C. 154(b) by 0 days.

(21) Appl. No.: 14/751,105

(22) Filed: Jun. 25, 2015

(65) Prior Publication Data

US 2016/0376080 A1 Dec. 29, 2016

(51) Int. Cl.
*B65D 75/30* (2006.01)
*B42F 7/06* (2006.01)

(52) U.S. Cl.
CPC ..... *B42F 7/065* (2013.01)

(58) Field of Classification Search
CPC .. B65D 75/30; B65D 5/5028; B65D 73/0021; A45C 7/0095; A45C 3/00
USPC ..... 206/482, 484; 383/39, 38; 150/147, 149
See application file for complete search history.

(56) References Cited

U.S. PATENT DOCUMENTS 2,253,814 A * 8/1941 Sames ..... A47G 1/141 40/776
3,759,305 A * 9/1973 McIntyre ..... A45C 1/06 150/149
4,629,070 A * 12/1986 Roberg ..... B42F 7/02 206/232
4,971,195 A * 11/1990 Mitsuyama ..... G11B 33/0422 206/308.1
5,833,063 A * 11/1998 Ho ..... G11B 33/0494 206/308.1
6,282,826 B1 * 9/2001 Richards ..... G09F 3/20 40/654.01

* cited by examiner

*Primary Examiner* — King M Chu

(57) ABSTRACT

An improved collectibles page for the storage and display of collectibles such as coins, sports cards, currency or business cards can be created by adding a flap to the front sheet of the page and corresponding slots to the back sheet of the page. These improvements allow for the retention of the collectibles within the collectibles page as well as providing an additional level of security against theft. These modifications can be implemented with minimal cost, providing product differentiation for the manufacturer while adding value to the collector. Adding these features involves altering the tooling used to create the collectibles page but does not add any additional materials or process steps.

3 Claims, 8 Drawing Sheets

RETENTION DEVICE FOR COLLECTIBLES IN PLASTIC COLLECTIBLES PAGES

BACKGROUND

Prior Art

Figure 1:
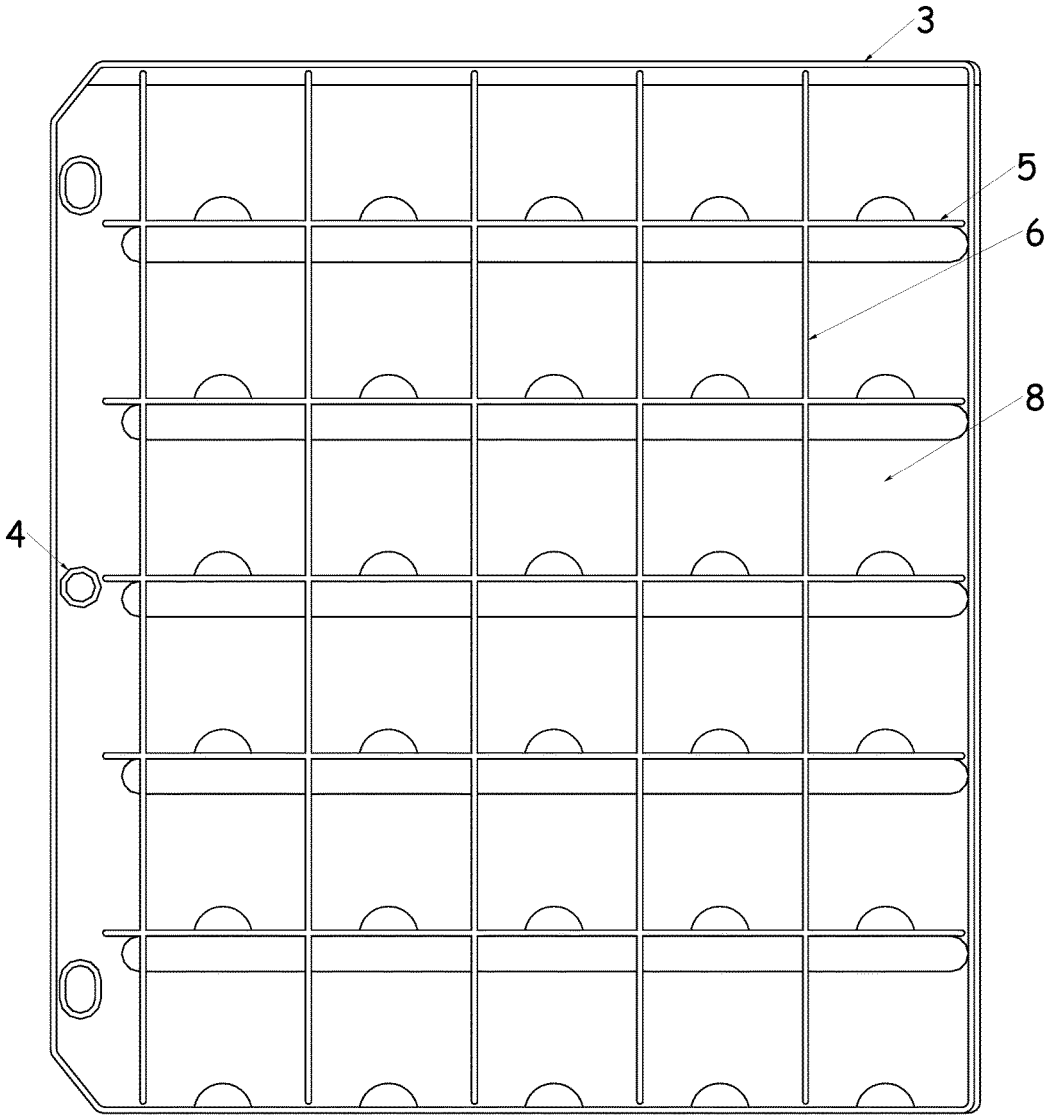

Collectibles pages are clear plastic pages that have multiple pockets into which the collectibles are placed. Once collectibles pages have collectibles in them, they are typically put into three ring binders. Collectibles pages protect the collectibles within and provide the ability to organize and view the collectibles. FIG. 1 shows a typical example of such a page.

Collectibles pages are formed by die cutting two sheets of clear plastic such as PVC, vinyl or polypropylene to the desired shape. The back sheet, shown in FIG. 4, is formed in the outline of the page with holes for the binder rings. The front sheet, shown in FIG. 3, has the same shape as well as slots that run most of the way from one side to the other. The two sheets are then heat sealed together to create the final collectibles page. The heat seal runs along the periphery of the pages as well as on a grid within the page. The heat seal grid along with the slots in the front page creates a series of flat-topped pockets within the field of the collectibles page. These pockets are open at the top and it is through this opening that a collectible is inserted into the pocket. Typical of pages constructed in this manner are the BCW PRO20T, Guard House Shield 9-Pocket Archival Pages SKU #13964032062 and the Lead Dog 30LD 30-pocket page.

While the current collectibles pages do an excellent job of holding the collectibles for display, they have a serious flaw. When a binder loaded with collectibles is dropped or picked up incorrectly, the collectibles can slide out of the pockets and be lost, damaged or disorganized. Additionally, having open top pockets allows for quick and easy removal of the contents. This makes theft of the contents easy when collectibles are displayed for sale in a binder full of collectibles pages.

A collectibles page that had a built in retention mechanism would avoid the disadvantages of the existing pages and be a superior product for the consumer. If the retention mechanism could be built into the pages without adding any additional parts or manufacturing steps, this would make them a more valuable product for the manufacturer. Having a built in retention mechanism also makes it more difficult for a thief to surreptitiously remove an item from a collectibles page.

SUMMARY

The addition of a flap 9 and mating slot 10 to a collectibles page provides for the positive retention of valuable collectibles. Such an addition is an easy no-cost improvement to collectibles pages that provides added value to the user and a product differentiator for the manufacturer.

DRAWINGS

Figures

Figure 2:
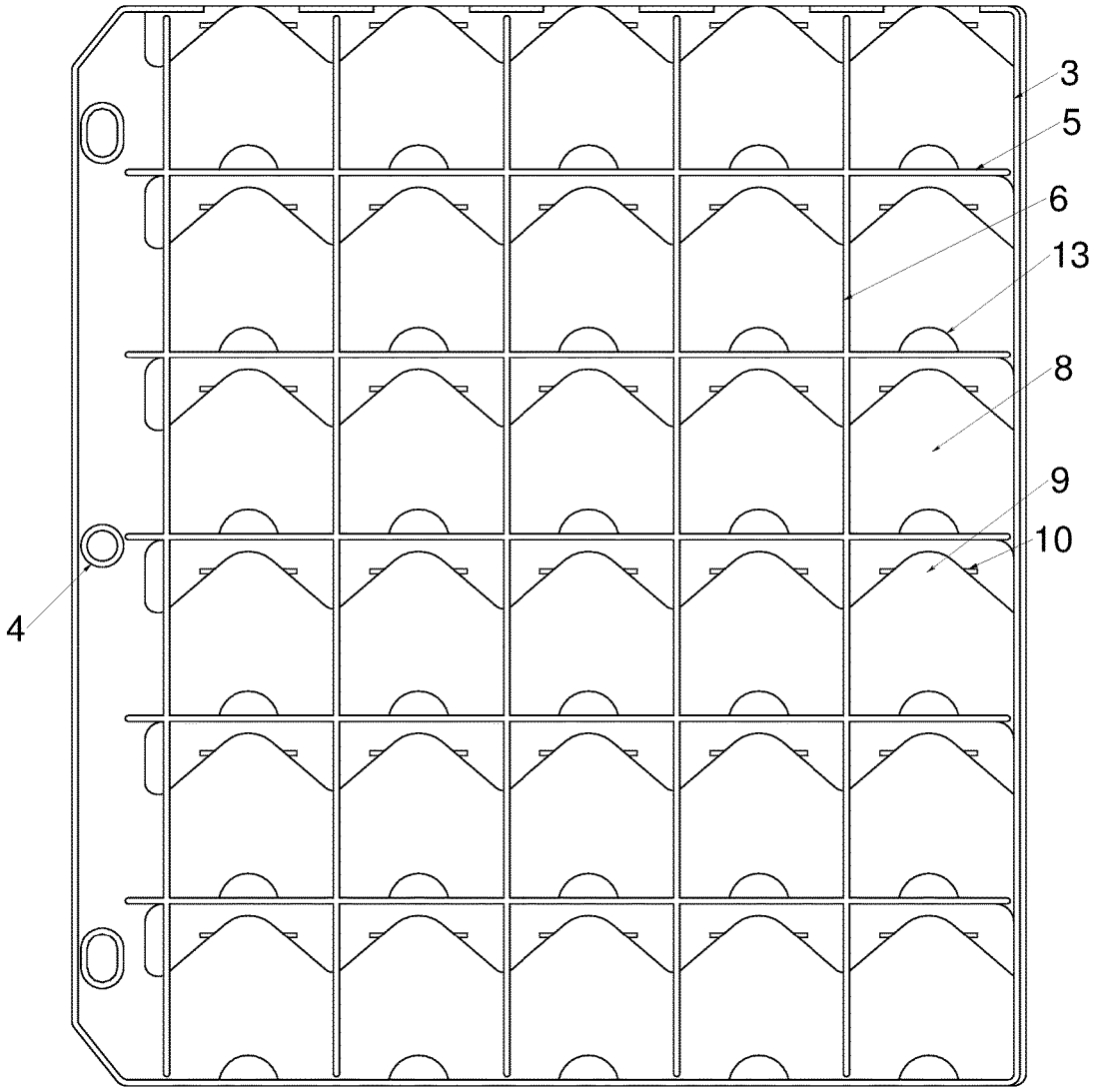
Figure 3:
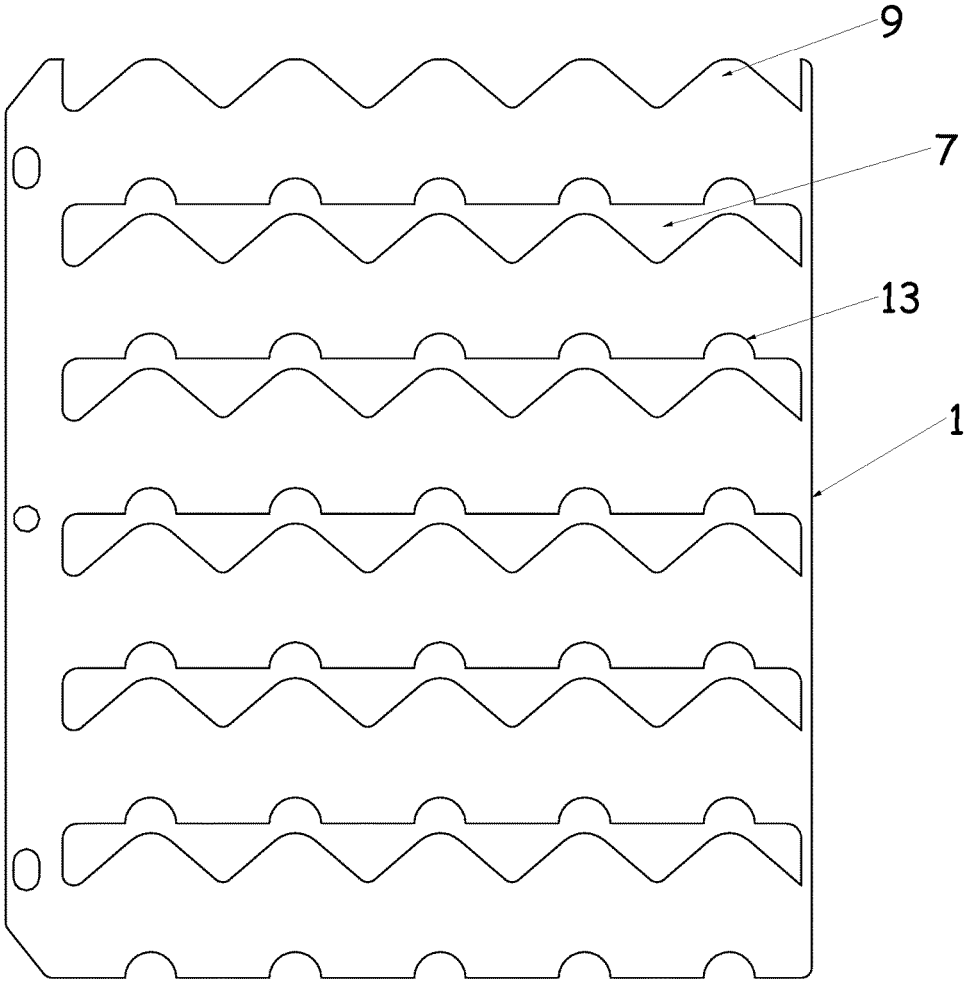
Figure 4:
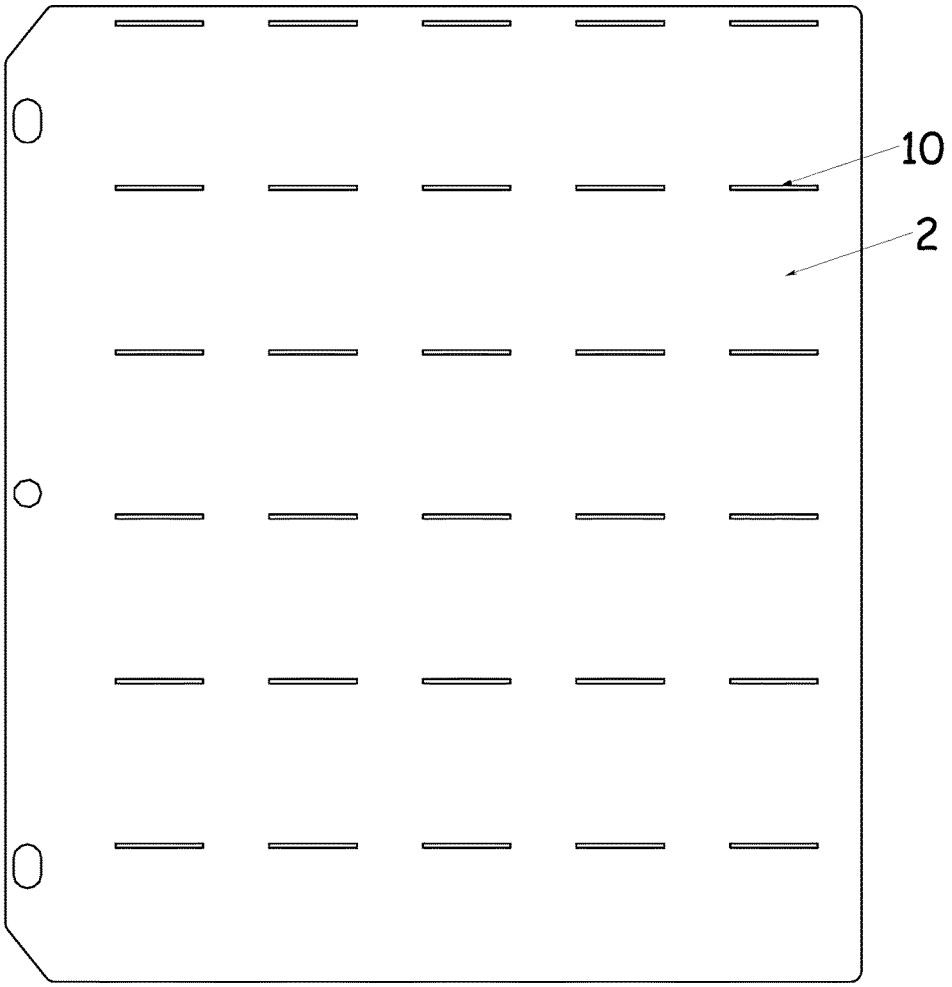
Figure 5:
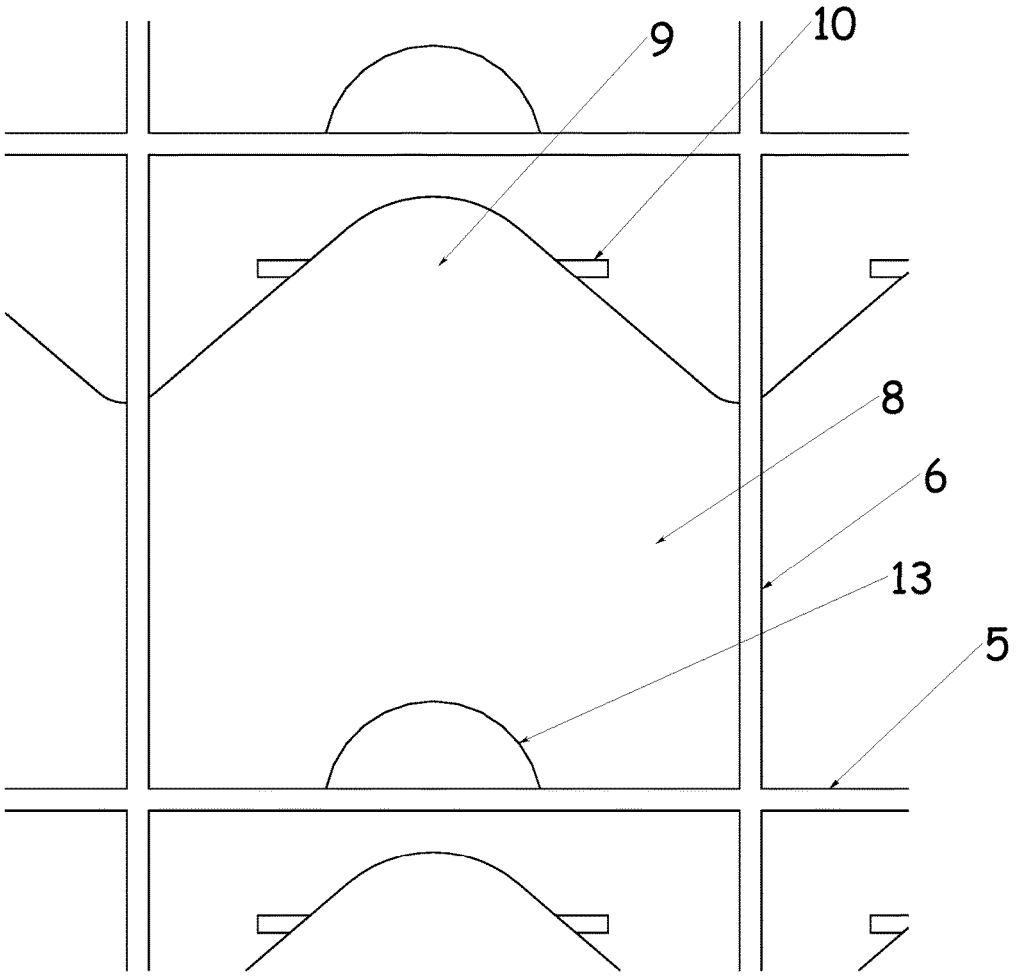
Figure 6:
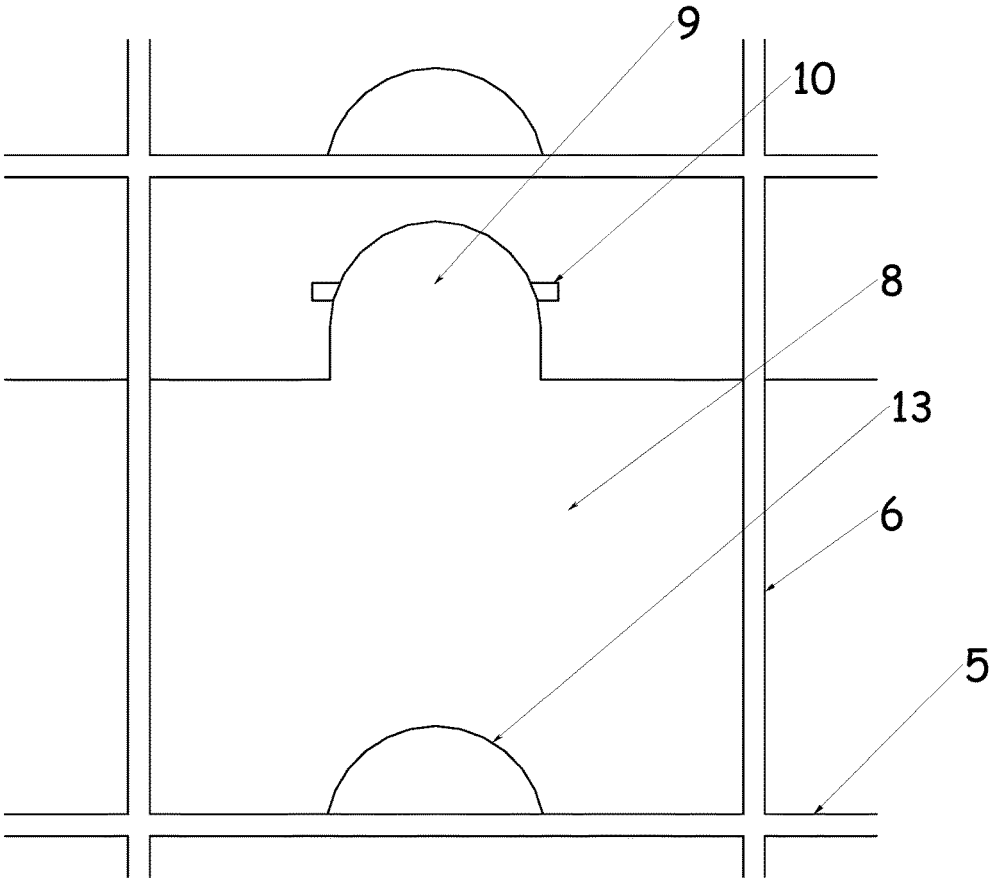
Figure 7:
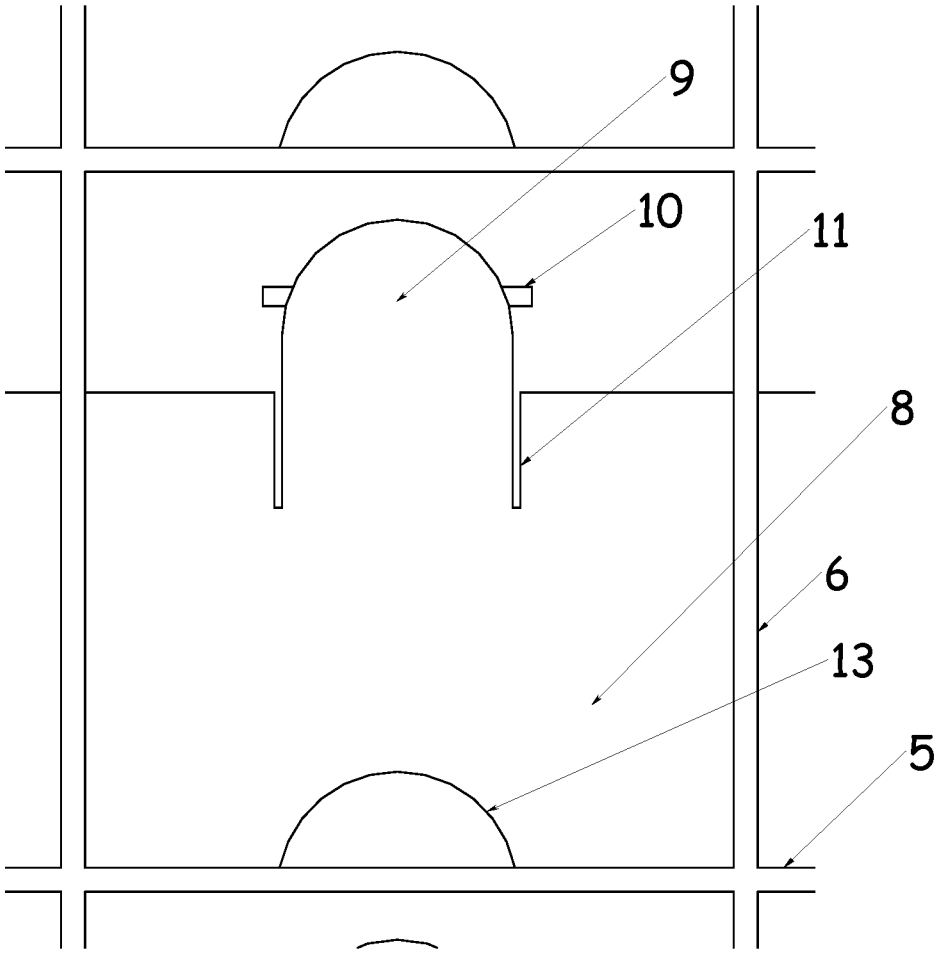
Figure 8:
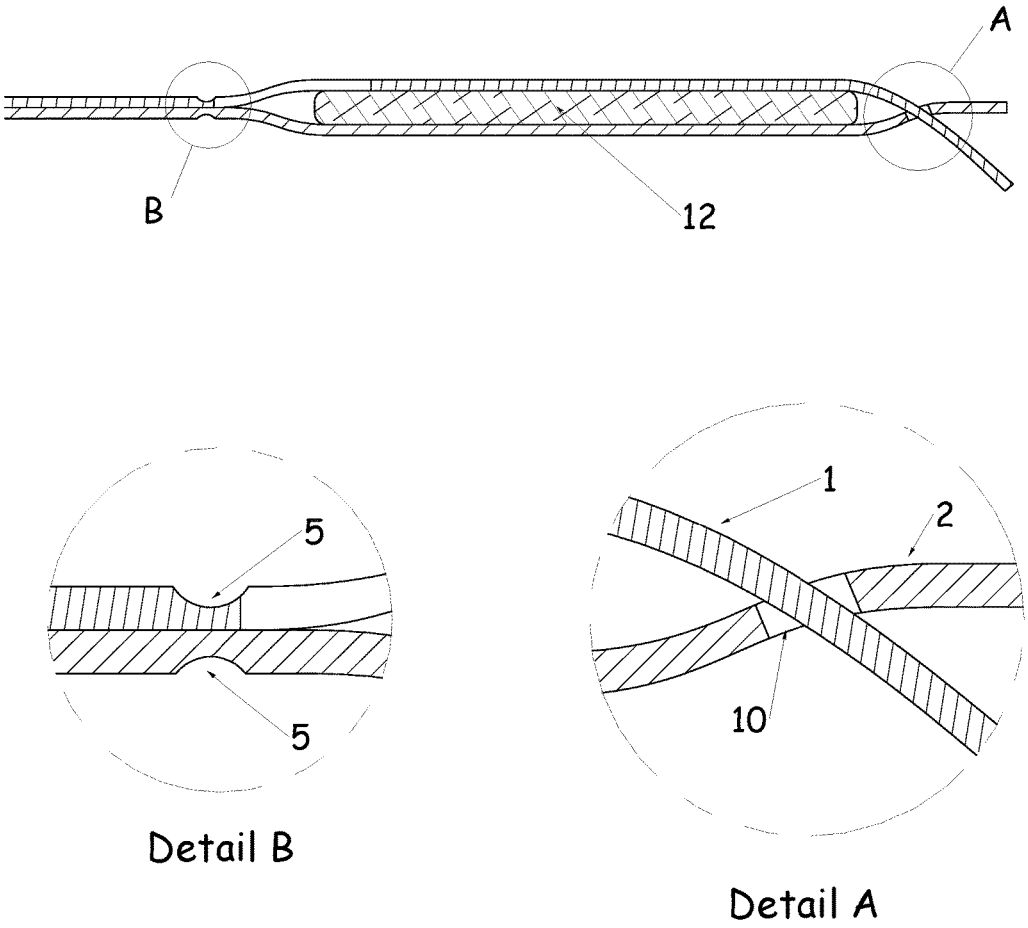

FIG. 1—Traditional collectibles page
FIG. 2—Improved collectibles page
FIG. 3—Improved collectibles page front sheet
FIG. 4—Improved collectibles page back sheet
FIG. 5—Triangular tab
FIG. 6—Square tab FIG. 7—Slotted square tab
FIG. 8—Pocket cross section

DRAWINGS

Reference Numerals

1. Front Sheet
2. Back Sheet
3. Perimeter heat seal
4. Ring hole heat seal
5. Horizontal pocket heat seal
6. Vertical pocket heat seal
7. Front sheet cutout
8. Pocket
9. Flap
10. Slit
11. Relief cut
12. Collectible
13. Removal Relief Cutout Theory of Operation FIG. 2 shows an improved collectibles page. The improvements involve modifying the collectibles page to include a flap 9 in the front sheet and a corresponding slit 10 in the back sheet at the open top of the pocket 8. By inserting the flap 9 in the slit 10, a collectible 12 present in the pocket 8 is positively retained. If the binder containing the collectibles page is dropped while the flap 9 is inserted in the slit 10, the collectible 12 will not fall out. Also, with the flap 9 engaged in the slit 10, additional actions are required to remove the collectible 12 from the pocket 8, making it more difficult to surreptitiously remove the contents. To remove a collectible, the flap 9 is removed from the slit 10 then the collectible 12 can be eased out of the pocket 8 by pushing on the collectible 12 through the removal relief cutout 13.

DETAILED DESCRIPTION

An improved collectibles page can be manufactured using the same processes used to produce existing collectibles pages. To implement the improvement, the cutouts in the front sheet 1 are modified to produce a new front sheet cutout 7 that includes the flap 9, and the process used to cutout the back sheet 2 is modified to cutout the slits 10. The heat seal apparatus may need to be modified so that the horizontal pocket heat seal 5 leaves the flap 9 unattached to the back sheet 2. Other than these changes, the manufacturing process is identical between the traditional collectibles page and the improved collectibles page.

To create the front sheet cutout 7 and the slits 10 in the back sheet, the production tooling would either receive a modified die or updated cutter programming. In designing the front sheet cutout 7, many different forms can be used for the flap 9. FIG. 5 shows a triangular shaped flap 9, FIG. 5 shows a rectangular flap 9 and FIG. 7 shows a rectangular flap 9 with a relief cut 11 on either side of the flap 9. The sharp corners of the flap 9 may be radiused as shown in FIGS. 5, 6 and 7 for ease of use, to provide better user comfort and to make tooling easier. The three flap 9 examples shown are just a subset of the possible flap 9 shapes. Other shapes will perform equally well and are envisioned as part of this patent.

Production would involve cutting out the front sheet 1, including the front sheet cutout 7, the page profile and the binder ring holes; cutting out the back sheet 2 profile, the binder ring holes and the slits 10; then joining the front sheet 1 to the back sheet 2 with a heat seal press that would create the perimeter heat seal 3, the binder ring hole heat seal 4, the horizontal pocket heat seal 5 and the vertical pocket heat seal 6.

Operation

To operate, the user would lift the flap 9 away from the back sheet 2, insert the collectible 12 into the pocket 8, then insert the flap 9 into the slit 10 to secure the collectible.

I claim:

1. A collectibles page comprising a front sheet attached to a back sheet, where the attachment of said front sheet to said back sheet results in the formation of pockets into which collectibles may be inserted and where said front sheet has cutouts that form flaps and where said back sheet has cuts that form slits, located where said flaps can be inserted into said slits and where the attachment of said front sheet to said back sheet is accomplished via a heat seal and where said front sheet has cutouts that additionally form removal relief cutouts at the bottom of the pocket.

2. A coin storage and presentation page comprising a front sheet attached to a back sheet, where the attachment of said front sheet to said back sheet results in the formation of pockets into which collectibles may be inserted and where said front sheet has cutouts that form flaps and where said back sheet has cuts that form slits, located where said flaps can be inserted into said slits and where the attachment of said front sheet to said back sheet is accomplished via a heat seal and where said front sheet has cutouts that additionally form removal relief cutouts at the bottom of the pocket.

3. A baseball card storage and presentation page comprising a front sheet attached to a back sheet, where the attachment of said front sheet to said back sheet results in the formation of pockets into which collectibles may be inserted and where said front sheet has cutouts that form flaps and where said back sheet has cuts that form slits, located where said flaps can be inserted into said slits and where the attachment of said front sheet to said back sheet is accomplished via a heat seal and where said front sheet has cutouts that additionally form removal relief cutouts at the bottom of the pocket.

* * * * *